US012697556B2

(12) United States Patent
Liao

(10) Patent No.: US 12,697,556 B2
(45) Date of Patent: Aug. 4, 2026

(54) ATTACHABLE HANDHELD FIDGET SPINNER

(71) Applicant: Karen Woojung Han Liao, Tustin, CA (US)

(72) Inventor: Karen Woojung Han Liao, Tustin, CA (US)

( * ) Notice: Subject to any disclaimer, the term of this patent is extended or adjusted under 35 U.S.C. 154(b) by 304 days.

(21) Appl. No.: 18/534,630

(22) Filed: Dec. 9, 2023

(65) Prior Publication Data

US 2025/0186896 A1 Jun. 12, 2025

(51) Int. Cl.
*A63H 1/00* (2019.01)
*A63H 17/26* (2006.01)
*A63H 27/00* (2006.01)

(52) U.S. Cl.
CPC ..... *A63H 1/00* (2013.01); *A63H 17/264* (2013.01); *A63H 27/02* (2013.01)

(58) Field of Classification Search
CPC ..... A63H 1/00; A63H 1/18; A63H 33/40
See application file for complete search history.

(56) References Cited

U.S. PATENT DOCUMENTS 6,364,734 B1 4/2002 Ng
6,530,816 B1 * 3/2003 Chiu ..... A63H 33/40 446/217
9,914,063 B1 * 3/2018 McCoskery ..... A63F 9/16
9,950,556 B1 * 4/2018 Laemle ..... B43K 23/08
10,016,693 B1 * 7/2018 Dowdy ..... B43K 29/00
10,406,450 B2 9/2019 Howard
10,414,204 B2 * 9/2019 Laemle ..... B43K 25/026
10,449,466 B2 10/2019 Kinmont, Jr.
10,625,172 B2 * 4/2020 Mak ..... A63H 33/00
11,400,385 B2 * 8/2022 Heine ..... A63H 37/00
2018/0353868 A1 12/2018 Albert
2019/0060774 A1 * 2/2019 Zhong ..... A44C 9/0053
2023/0302377 A1 * 9/2023 DeStefano ..... A63H 1/00

FOREIGN PATENT DOCUMENTS

CN 206965117 U 2/2018
JP 7229414 B1 2/2023
KR 200483621 Y1 6/2017
KR 200494604 Y1 * 11/2021 ..... A63H 33/002

* cited by examiner

*Primary Examiner* — Nicholas J. Weiss

(57) ABSTRACT

An attachable handheld fidget spinner is provided. The spinner comprises a wing portion comprising a cavity and a blade, the blade having a proximal end near the cavity and a distal end away from the cavity, the blade having an increasing depth and an increasing width from the proximal end toward the distal end; and a core disposed inside the cavity, the core comprising a cylindrical disc, the cylindrical disc comprising a holding surface disposed at the center of the cylindrical disc; an outer ring surrounded the holding surface; and a core groove in between the holding surface and the outer ring, the outer ring comprising protrusions facing the core groove, the protrusions configured to removably attach to an object. The attachable handheld fidget spinner kit and methods of using the kit are disclosed.

19 Claims, 10 Drawing Sheets

ATTACHABLE HANDHELD FIDGET SPINNER

TECHNICAL FIELD

The present disclosure generally relates to a fidget spinner and the attachment feature that is capable of attaching the fidget spinner to another subject without interfering with its stability and bearing structure.

BACKGROUND

Currently, there are various shapes and types of fidget spinners with low sustainability and stability to have consistent long last spinning cycle on its own. These low stability fidget spinners have even harder time to maintain stability when the fidget spinners are attaching to another object. The current way of attaching mechanism either prevents a user from holding and using the fidget spinner with fingers or changes the how the fidget spinner spins and produces a different or more unstable spinning. A conventional fidget spinner is known in the art to be played by having one finger on top and one finger on the bottom of the fidget spinner holding on the top plate and the bottom plate. In one scenario, the fidget spinner is designed to include a mounting member together with a fidget spinner. To compensate for having a mounting member or a mounting member structure, the fidget spinner is designed to have low stability because of the shape of the mounting member and the bearing structure and its associated stability structure. Either top or bottom of the fidget spinner is connected to a mounting component preventing a user from holding the fidget spinner directly. The mounting member is capable to attach another object. The spinning mechanism of the fidget spinner is altered after the mounting member attaches to the object. The mounting member or the object attached comprises additional axel allowing the fidget spinner to take the additional axel as the new bearing for rotation, which tends to be less stable and less sustainable than the fidget spinner without the mounting member.

In other scenario, the mounting member is a separate adapter independent of the fidget spinner or the object to be attached. This mounting adapter includes a new axel or a bearing structure. Once attached, the fidget spinner will rest and spin on the new axel or the bearing structure. With the new structure attached, the fidget spinner's spinning speed and stability are also changed and typically for decrease functionality. The new bearing structure does not match the fidget spinner as closely as the original bearing system. The attached fidget spinner last shorter spinning cycle when similar force is applied to it.

The use of the fidget spinner is thus polarized. A user is left to choose sacrificing the stability of the fidget spinner or sacrificing the portability of the fidget spinner. Accordingly, there exists a need for an attachable handheld fidget spinner that allows a user to enjoy the traditional fidget spinner play with two fingers on the top and bottom of the fidget spinner and attach the fidget spinner when desired without sacrificing the stability and the spinning cycles. This disclosure describes an improvement over these prior technologies.

SUMMARY

In one embodiment, an attachable handheld fidget spinner is provided. The attachable handheld fidget spinner comprises a wing body having a cavity; and a core disposed inside the cavity, the core comprising a cylindrical disc, the cylindrical disc comprising a holding surface disposed at the center of the cylindrical disc and an outer ring surrounded the holding surface, the outer ring comprising protrusions configured to removably attach to an object.

In some embodiments, a kit for an attachable handheld fidget spinner is provided. The attachable handheld fidget spinner kit comprises an attachable handheld fidget spinner comprising a wing body having a cavity; and a core disposed inside the cavity, the core comprising a cylindrical disc, the cylindrical disc comprising a holding surface disposed at the center and an outer ring surrounded the holding surface; and a base comprising an extension such that the extension is removably attached to the core.

In some embodiments, a method of using an attachable handheld fidget spinner is provided. The method comprises providing an attachable handheld fidget spinner comprising a wing body having a cavity; and a core disposed inside the cavity, the core comprising a cylindrical disc, the cylindrical disc comprising a holding surface disposed at the center and an outer ring surrounded the holding surface; providing a base comprising an extension such that the extension is removably connected to the holding surface; aligning the holding surface and the extension; and pushing the holding surface into the base such that the attachable handheld fidget spinner is removably attached to the base.

Additional features and advantages of various embodiments will be set forth in part in the description that follows, and in part will be apparent from the description, or may be learned by practice of various embodiments. The objectives and other advantages of various embodiments will be realized and attained by means of the elements and combinations particularly pointed out in the description and appended claims.

BRIEF DESCRIPTION OF THE DRAWINGS

The present disclosure will become more readily apparent from the specific description accompanied by the following drawings, in which.

DETAILED DESCRIPTION

Figure 1:
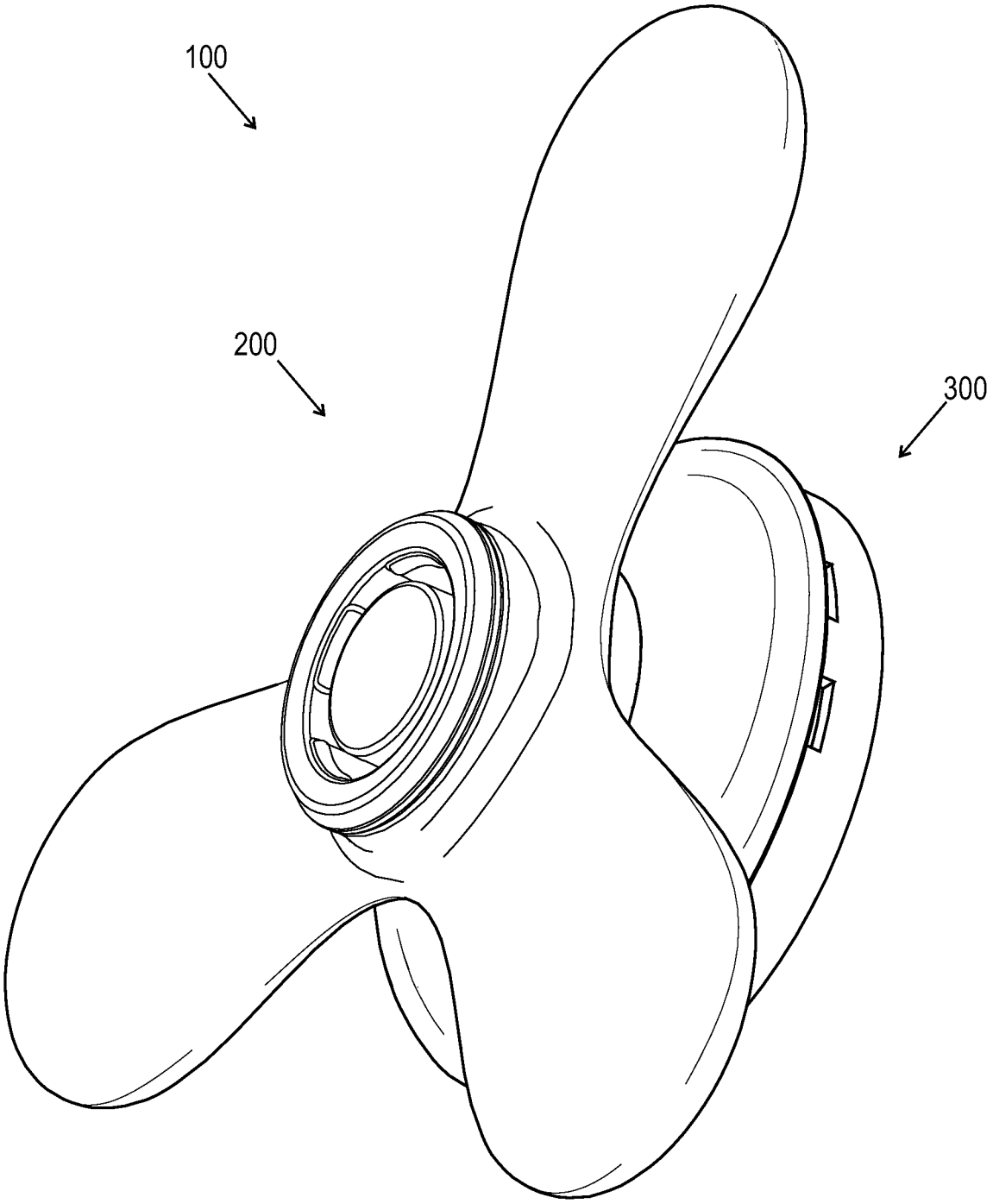
FIG. 1 is a perspective view of one embodiment of a kit for an attachable handheld fidget spinner including a spinner and a base.

The exemplary embodiments of the attachable handheld fidget spinner including a kit with a base, and related methods of use disclosed are discussed in terms of toys and handheld products. It is to be understood that the disclosed embodiments and the combination of different embodiments are merely exemplary that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present disclosure.

The attachable handheld fidget spinner and the kit of the present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. In some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a kit including attachable handheld fidget spinner and a base, related components and methods of employing the attachable handheld fidget spinner onto the base in accordance with the principles of the present disclosure. Alternate embodiments are also disclosed. Reference is made in detail to the exemplary embodiments of the present disclosure, which are illustrated in the accompanying figures.

The components of attachable handheld fidget spinner kit 100 for can be fabricated from various materials suitable from a toy with child friendly materials to rubber, elastomeric material, including metals, woods, bamboo, polymers including plastics, ceramics and and/or their composites. Various components of attachable handheld fidget spinner kit 100 may have material composites, including the above materials, to achieve various desired characteristics such as strength, rigidity, elasticity, compliance, durability and child-safety. The components of attachable handheld fidget spinner kit 100, individually or collectively, may also be fabricated from a heterogeneous material such as a combination of two or more of the above-described materials. The components of attachable handheld fidget spinner kit 100 may be monolithically formed, integrally connected or include fastening elements and/or instruments, as described herein.

Figure 2:
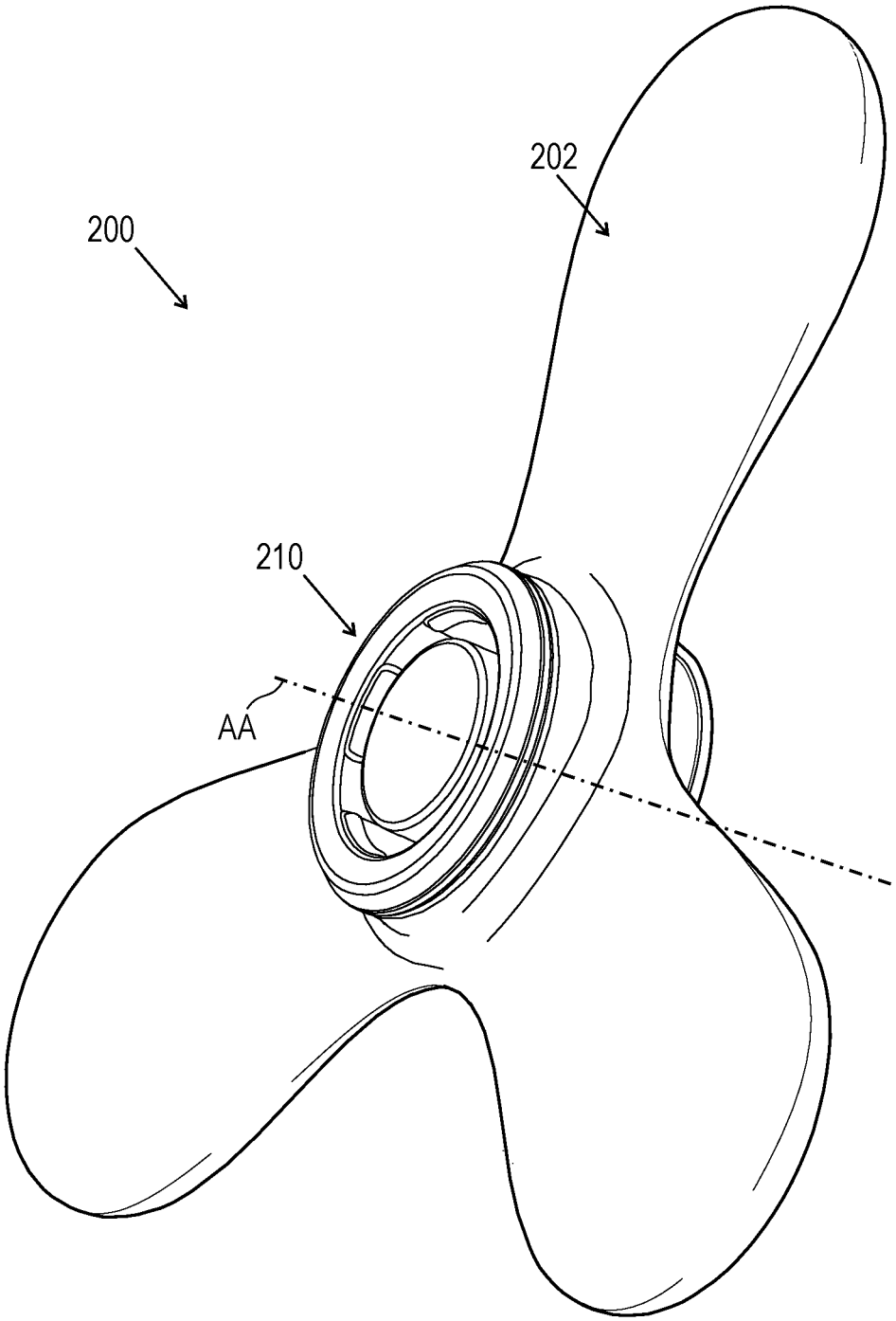
FIG. 2 is a perspective view of one embodiment of the attachable handheld fidget spinner shown in FIG. 1.
Figure 3:
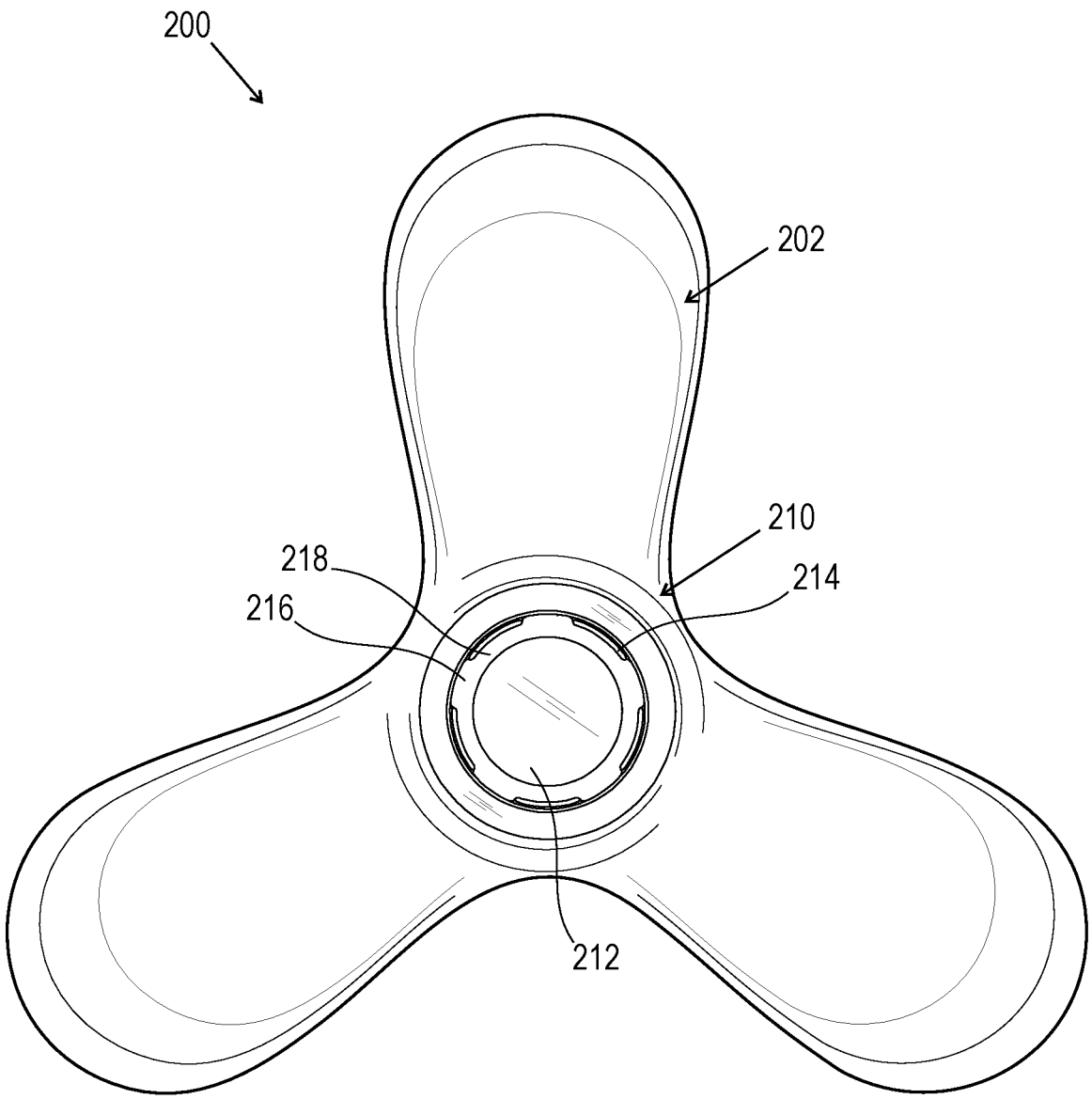
FIG. 3 is a top view of the attachable handheld fidget spinner shown in FIG. 2.

In some embodiments, the attachable handheld fidget spinner kit comprising, consisting essentially of, or consisting of the following features is provided. Attachable handheld fidget spinner kit 100 includes attachable handheld fidget spinner 200 and base 300, as shown in FIG. 1. Attachable handheld fidget spinner 200 has a wing portion 202 comprising a blade and a body with cavity connecting to the blade. Attachable handheld fidget spinner further includes core 210 disposed inside the cavity of the wing portion, as shown in FIG. 2. FIG. 3 shows a top view of the attachable handheld fidget spinner, which includes holding surface 212 for a user to exert force and hold the spinner steady. Adjacent to holding surface is a ring of frame 214 having bridges 216 connected to an outer ring of the core. There are a plurality of space or gap on the frame to provide flexure and stability of the core.

Figure 4:
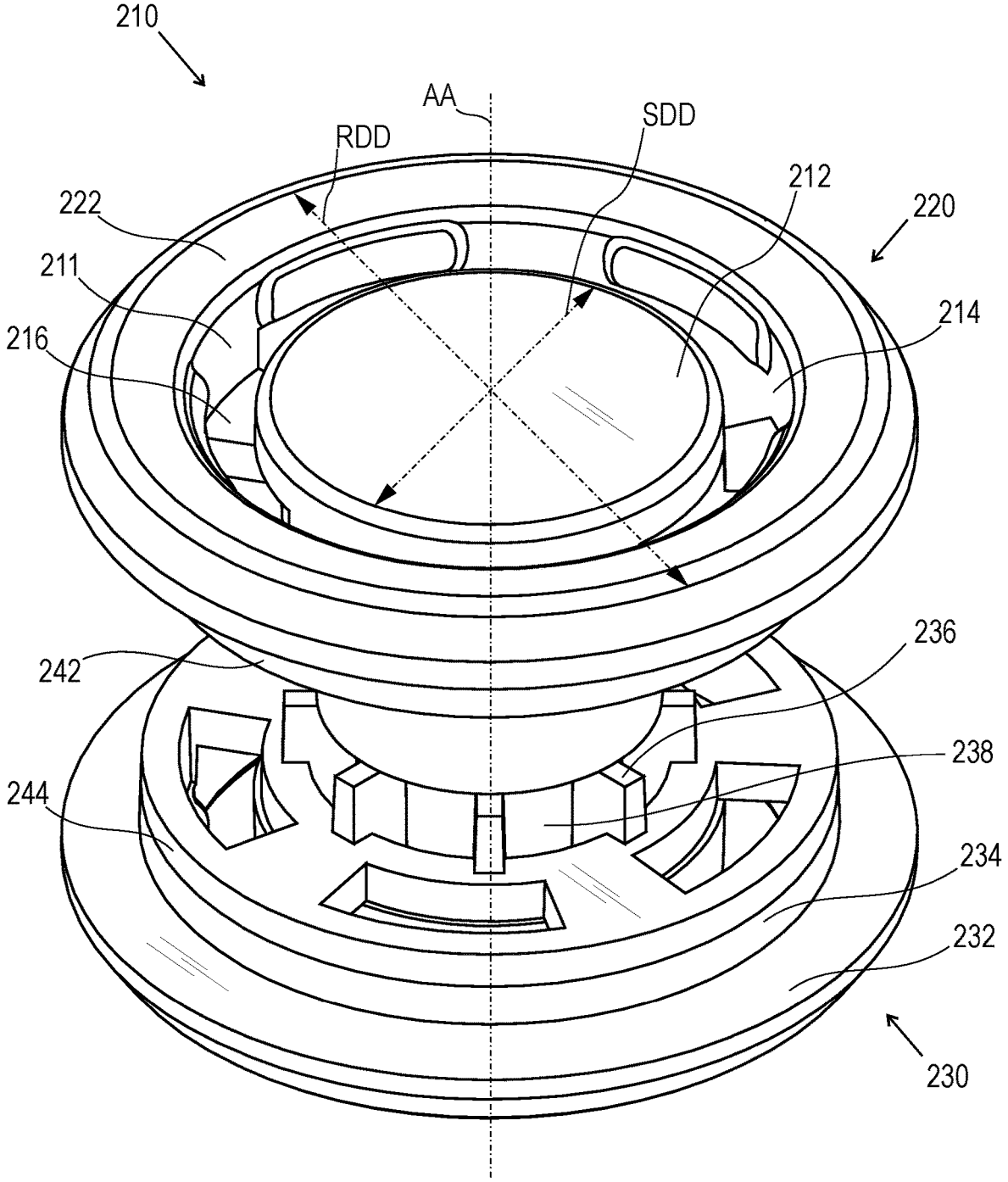
FIG. 4 is a perspective view of the core of the attachable handheld fidget spinner shown in FIG. 2.

FIG. 4 is a perspective view of the core. In some embodiments, the core comprises first portion 220 and second portion 230. In some embodiments, the first portion is a top or a cylindrical disc from a top view. The first portion comprises the holding surface, the frame, the bridge and the outer ring. Between the outer ring and the holding surface is a space or a core groove 211 configured to receive the base. The second portion comprises outer ring 232, ring of frame or inner ring 234, gear teeth 236, and axel ring 238. In between the first portion and the second portion is a stability ring configured to contact the wing portion and allow the wing portion to spin or rotate on the ring. In some embodiments, there are two stability rings. First stability ring 242 adjacent to the first portion and second stability ring 244 adjacent to the second portion. In some embodiments, the core further comprises balls (not shown), cylinders and other structures between the stability rings. In some embodiments, bearing structures are between the core and the wing portion. The core comprises a longitudinal axis AA across the first portion, the first stability ring, the second portion and the second stability ring. The core also comprises a ring diameter RDD across the outer ring of either the first portion or the second portion and a surface diameter SDD across the holding surface of either the first portion or the second portion. In some embodiments, RDD is from about 0.5, 0.6, 0.7, 0.8, 0.9, 1, 1.1, 1.2, 1.3, 1.4 to about 1.5 cm. In some embodiments SDD is from about 0.3, 0.4, 0.5, 0.6, 0.7, 0.8, 0.9, 1, 1.1, 1.2, 1.3, 1.4 to about 1.5 cm. In some embodiments, the core is formed as a monolithic body inside the wing portion. In some embodiments, the holding surface comprises a dip such that the RDD forms a curvature that increase grip for a user. In some embodiments, the curvature is formed by an arc angle of about 23 degrees. In some embodiments the curvature is formed by an arc angle of about 15, 16, 17, 18, 19, 20, 21, 22, 23, 24, 25, 26, 27, 28, 29, 30, 31, 32, 33, 34 to about 35 degrees.

Figure 5:
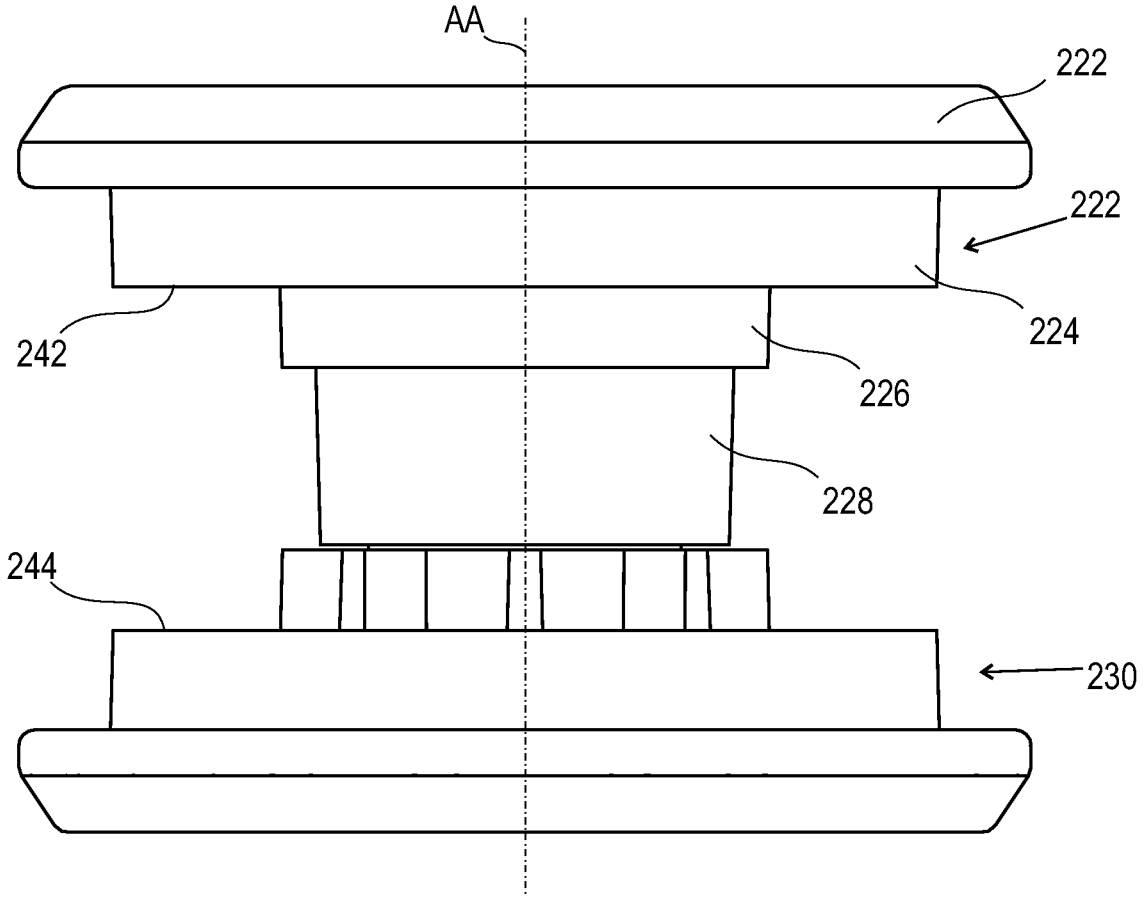
FIG. 5 is a side view of one embodiment of the core shown in FIG. 4.

FIG. 5 is a side view of the core. In some embodiments, the first portion comprises outer ring 222, inner ring 224, which serves as a base for the ring of frame 214, tapered ring 226 and axel ring 228, which correspond and enclose the axel ring of the second portion.

Figure 6:
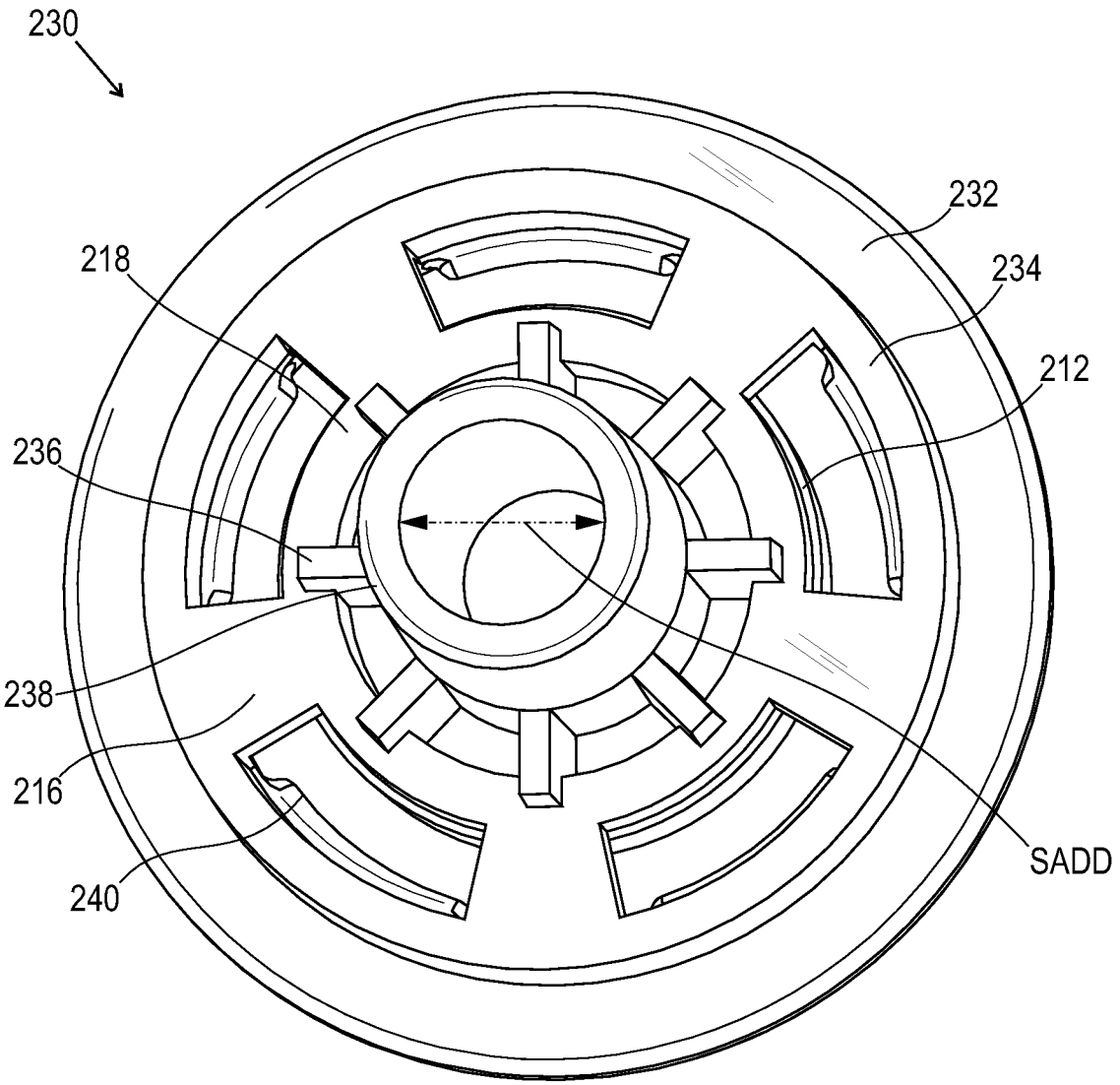
FIG. 6 is a perspective view of one embodiment of a component of the core shown in FIG. 5.

FIG. 6 is a perspective view of the second portion. In some embodiments, the second portion comprises outer ring, inner ring, gear teeth, axel ring. In some embodiments, similar to the first portion, the second portion also comprises bridge 216 and frame 218 and a flexure gap between the outer ring and the inner ring. The flexure gap provides stability of the frame and prevent an over-rigid structure from cracking. In some embodiments, the outer ring comprises inner boss or protrusion 240. In some embodiments, the protrusion comprises various shapes including circle, semi-circle oval, doughnut, rectangle, square, pentagon, hexagon, octagon, and/or a combination there of. The axel ring of the second portion has a diameter SADD.

Figure 7:
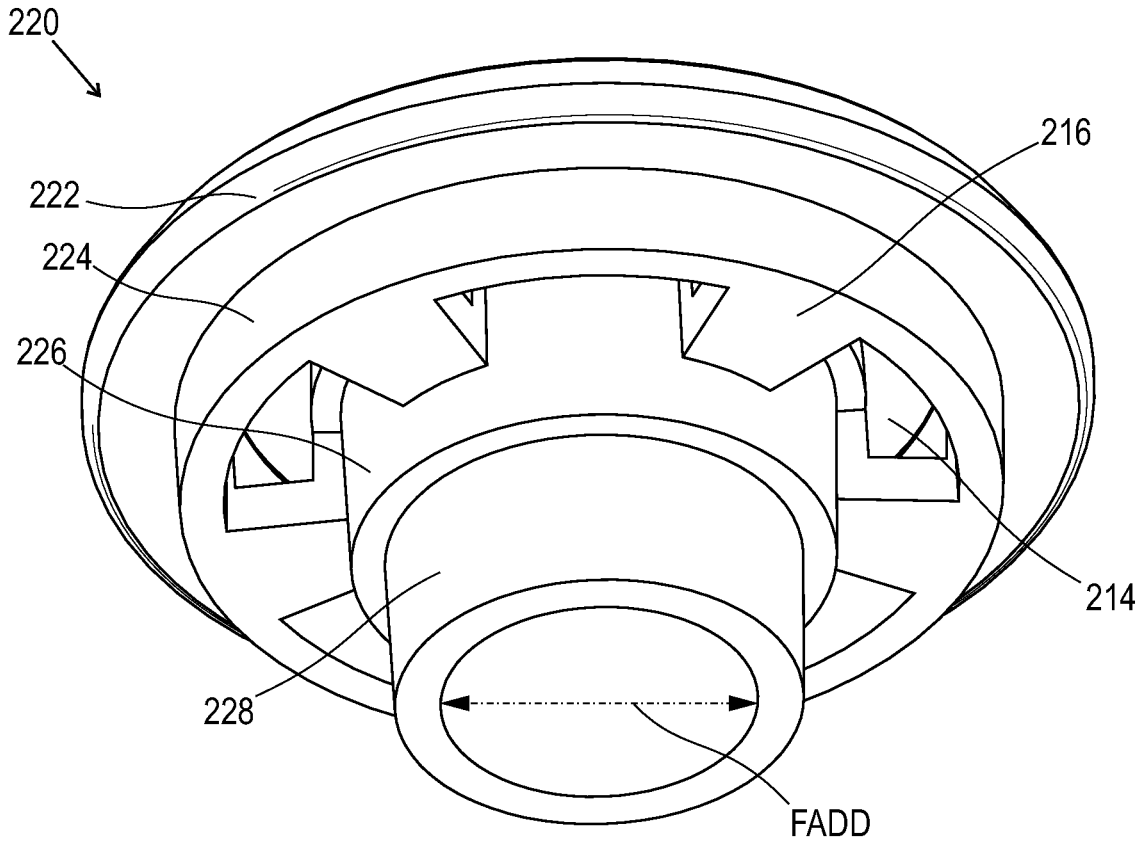
FIG. 7 is a perspective view of one embodiment of another component of the core shown in FIG. 5.

FIG. 7 is a perspective view of first portion of the core. In some embodiments, the first portion comprises outer ring, inner ring, tapered ring and axel ring. The first portion comprises bridge and frame and flexure gap 214 between the outer ring and the inner ring. The axel ring of the first portion has a diameter FADD. In some embodiments, FADD is larger than SADD such that the axel ring of the first portion encloses the axel ring of the second portion and secures the first portion and the second portion together to form a core secured inside the wing body. In some embodiments, the FADD is smaller than the SADD such that the axel ring of the second portion encloses the axel ring of the first portion and secures the first portion and the second portion together to form a core secured inside the wing body. In some embodiments FADD and SADD have the same diameters and the perimeter of the axel ring of both the first portion and the second portion are configured to secure each other. In some embodiments, the axel rings are secure by adhesive. In some embodiments, the axel rings are secured by having corresponding shapes configured to mate or snap in such that the first portion and the second portion are secured together to form a core secured inside the wing body. In some embodiments, FADD is from about 0.1, 0.2, 0.3, 0.4, 0.5, 0.6, 0.7, 0.8, 0.9 to about 1 cm. In some embodiments, SADD is from about 0.1, 0.2, 0.3, 0.4, 0.5, 0.6, 0.7, 0.8, 0.9 to about 1 cm.

Figure 8:
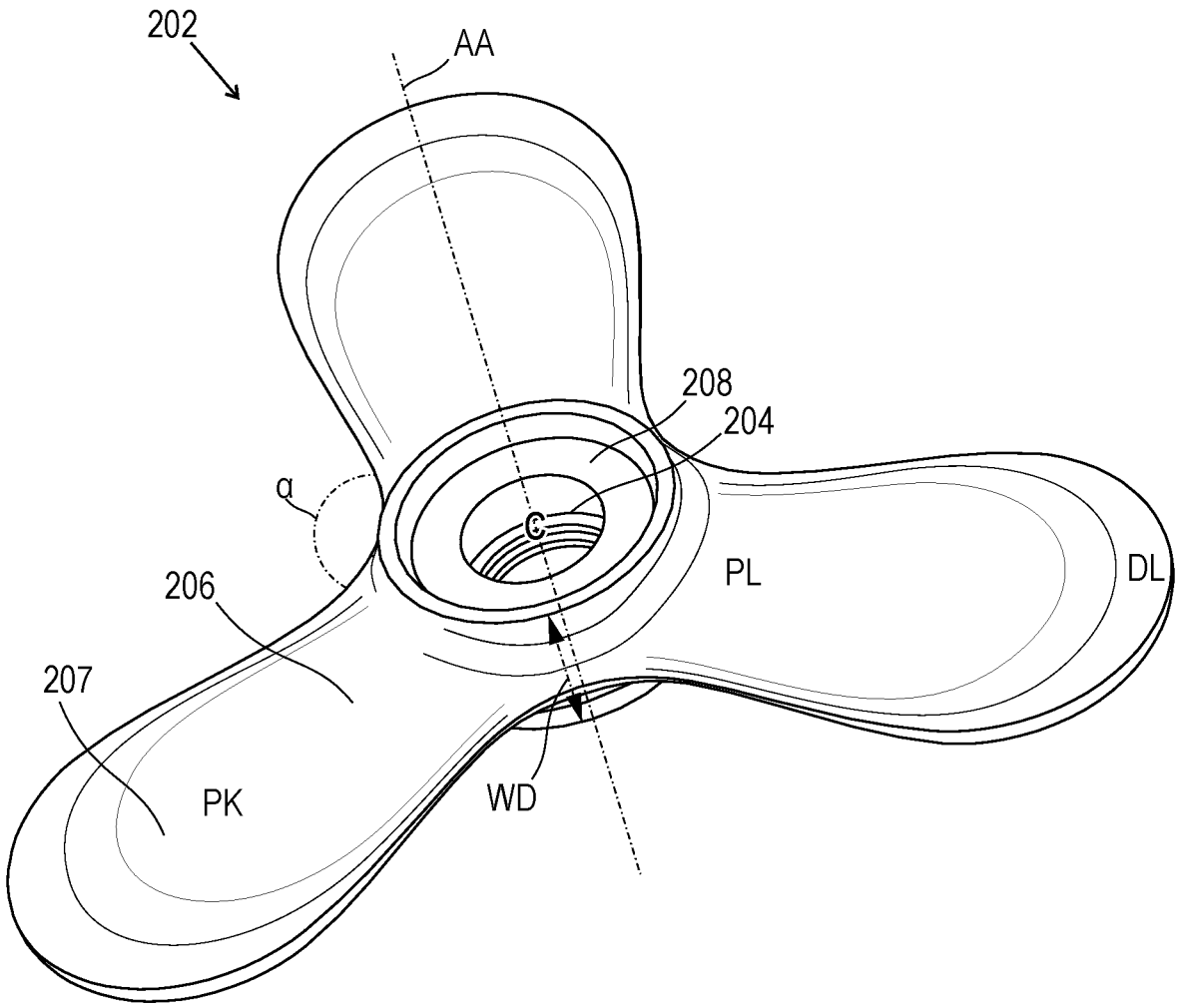
FIG. 8 is a perspective view of a wing portion of an attachable handheld fidget spinner shown in FIG. 2.

FIG. 8 is a perspective view of the wing portion. In some embodiments, the wing portion comprises grooves 204 configured to mate and receive the stability rings from the core such that that the stability rings can provide the wing portion with sufficient stability to spin for longer time cycles. The wing portion 202 comprises blade 206 and a wing body 208 with a cavity disposed in the center connecting all blades. In some embodiments, the blade having a lobe portion 207 toward a tip of the blade. The lobe portion has a peak in thickness at a distal end of the blade and tapered down in thickness toward a distal edge of the blade. In some embodiments, the wing portion has a center C having a cavity. The cavity is connected to a plurality of blades. The blade extends from a proximal end PL near the center to a distal end DL. In some embodiments, the wing portion is formed as a monolithic body. The wing portion has a depth WD extending along the longitudinal axis AA. In some embodiments, the blade has a gradual increasing depth from the proximal end toward the distal end. The increasing depth peaked at a peak PK, then the depth deceases from the PK toward the distal end. In some embodiments, the depth of the proximal end is less than the depth of the distal end. The depth has such profile to maintain stability of the blade and decrease the interference and unwanted engagement between the blade and the base. In some embodiments, there are five protrusions. In some embodiments, the blade comprises one, two, three, four five, six, seven, eight, nice, ten, eleven, twelve, thirteen, fourteen, fifteen, sixteen, seventeen, eighteen, nineteen, or twenty blades. In some embodiments, the blades are evenly distributed around the perimeter of the wing body. The blades are separated by angle $\alpha$. In some embodiments, angles range from about 10, 15, 20, 25, 30, 35, 40, 45, 50, 55, 60, 65, 70, 75, 80, 85, 90, 95, 100, 105, 110, 115, to about 120 degrees. In some embodiments, there is one single blade where the blade is a disc around the wing body. In some embodiments, the proximal end of the blade has a depth of about 0.3 cm. In some embodiments, the proximal end of the blade has a depth of about 0.2, 0.3, 0.4, 0.5, 0.6, 0.7, 0.8, 0.9 to about 1 cm. In some embodiment the peak has a depth of about 0.5 cm. In some embodiments, the peak of the blade has a depth of about 0.5, 0.6, 0.7, 0.8, 0.9 to about 1 cm. In some embodiments, the peak has a depth larger than a depth of the proximal end and the distal end. In some embodiments, the distal end of the blade has a depth of about 0.4 cm. In some embodiments, the distal end of the blade has a depth of about 0.2, 0.3, 0.4, 0.5, 0.6, 0.7, 0.8, 0.9 to about 1 cm. In some embodiments, the blade has a length from about 1, 2, 3, 4, 5 cm from the proximal end to the distal end.

In some embodiments, the attachable handheld fidget spinner comprises a wing body having a cavity; and a core disposed inside the cavity, the core comprising a cylindrical disc, the cylindrical disc comprising a holding surface disposed at the center of the cylindrical disc and an outer ring surrounded the holding surface, the outer ring comprising protrusions configured to removably attach to an object. In some embodiments, the object is a base having an extension configured to engage the cylindrical disc. In some embodiments, the cylindrical disc further comprises a bridge connecting the holding surface to the outer ring. In some embodiments, the protrusion disposed on an inner perimeter of the outer ring. In some embodiments, the protrusion comprises a rectangular shape having a higher body and a lower and tapered edge configured to removably attach to the object. In some embodiments, the core further comprises a second cylindrical disc having a second holding surface and a second outer ring. In some embodiments the protrusion on the outer ring has a width of about 0.2, 0.3, 0.4, 0.5, 0.6, 0.7, 0.8, 0.9 to about 1 cm.

In some embodiments, the core further comprises a first ring and a second ring disposed between the cylindrical disc and a second cylindrical disc, the first ring and the second ring configured to contact an inner groove of the wing body. In some embodiments, the cylindrical disc has an axel ring and the core further comprises a second cylindrical disc having a second axel ring such that the first axel ring and the second axel ring mate to form an hourglass-like structure. In some embodiments, the cylindrical disc further comprises a groove disposed between the holding surface and the outer ring configured to receive an object. In some embodiments, the second cylindrical disc comprises an axel ring having teeth surrounded the axel ring.

In some embodiments, an attachable handheld fidget spinner comprising a wing portion having a longitudinal axis, the wing portion comprising a cavity disposed at a center of the wing portion and a blade extending transverse to the longitudinal axis, the blade comprising a proximal end near the center a distal end away from the center, and a depth extending along the longitudinal axis, the proximal end has a shorter depth than a depth of the distal end; and a core disposed inside the cavity, the core comprising a cylindrical disc, the cylindrical disc comprising a holding surface disposed at the center of the cylindrical disc and an outer ring surrounded the holding surface, the cylindrical disc further comprising a core groove in between the holding surface and the outer ring, the outer ring comprising protrusions facing the core groove, the protrusions configured to removably attach to an object.

In some embodiments, an attachable handheld fidget spinner comprising a wing portion comprising a cavity and a blade, the blade having a proximal end near the cavity and a distal end away from the cavity, the blade having an increasing depth and an increasing width from the proximal end toward the distal end; and a core disposed inside the cavity, the core comprising a cylindrical disc, the cylindrical disc comprising a holding surface disposed at the center of the cylindrical disc; an outer ring surrounded the holding surface; and a core groove in between the holding surface and the outer ring, the outer ring comprising protrusions facing the core groove, the protrusions configured to removably attach to an object.

In some embodiments, the attachable handheld fidget spinner comprises essentially of a wing portion and a core. The spinner does not have any additional or separate mounting member.

Figure 9:
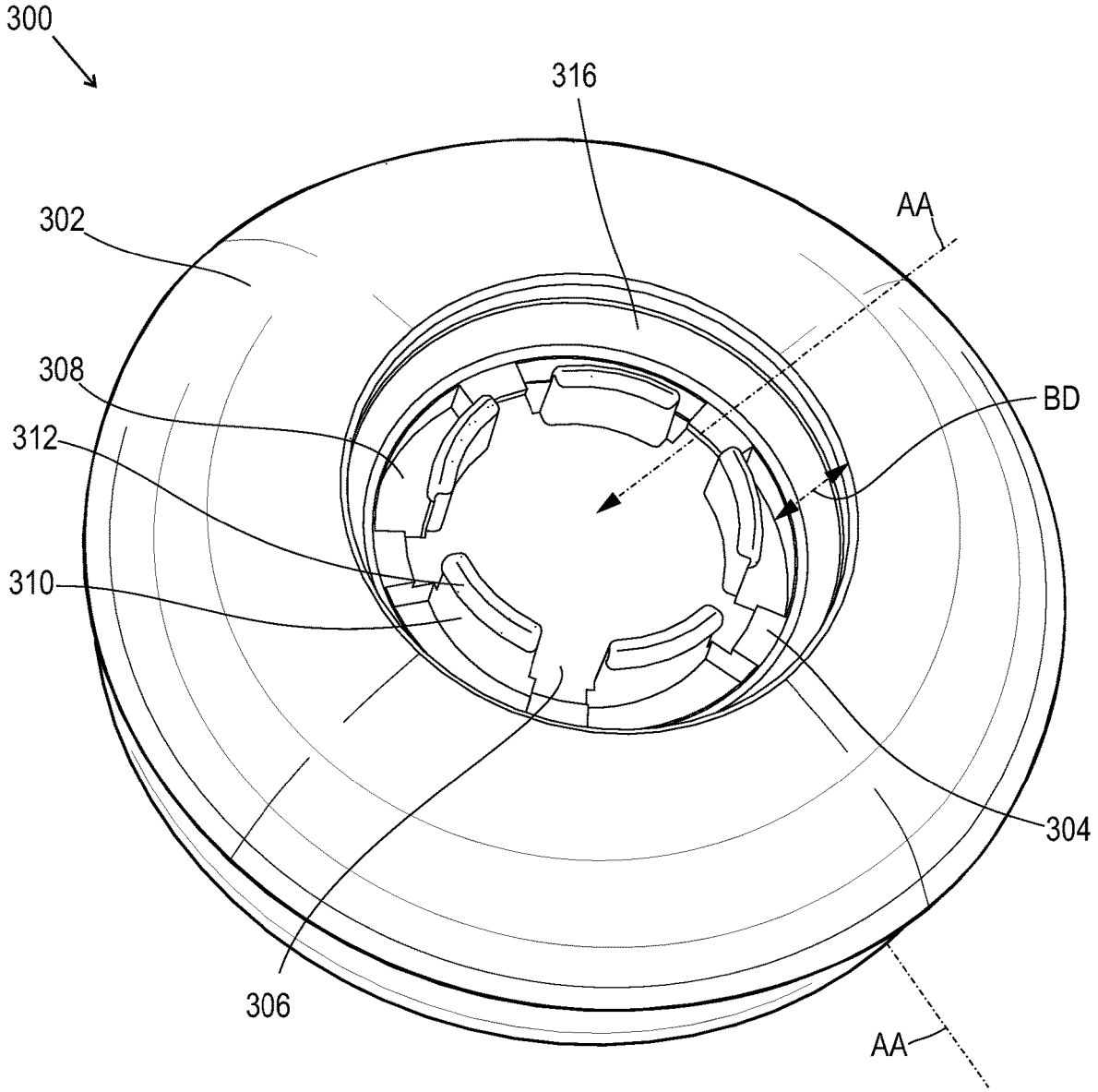
FIG. 9 is a perspective view of one embodiment of a base shown in FIG. 1.

FIG. 9 is a perspective view of a base. In some embodiments, base 300 comprises base frame 302, base bridge 304, base depression 306, flexure gap 308, and extension 310 from the base frame. The extension extends in the direction of the longitudinal axis AA and has a depth of the base depression from the proximal end of the extension at the bottom of the depression to the distal end of the extension at the top of base. The extension further comprises a boss 312 forming a hook at its distal end. In some embodiments, the extension forms a loop or center groove 314 corresponding to a perimeter of the holding surface of the core. Once attached, the extension will enclose the holding surface. The base frame has an outer most edge forming an outer perimeter of the base frame. The gap between the outer perimeter and the extension forms a second loop or an outer groove 316 corresponding to a perimeter of the outer ring of the core. Once attached, the outer ring will be enclosed inside the outer groove.

In one embodiment, the depression has a depth of 0.5 cm. In some embodiments, the depression has a depth of about 0.3, 0.4, 0.5, 0.5, 0.6, 0.7, 0.8, 0.9, to about 1 cm. In some embodiment the length of the extension is the same as the depth of the depression. In some embodiments, the length of the extension is about 0.5 cm. In some embodiments, the length of the extension is from about 0.3, 0.4, 0.5, 0.5, 0.6, 0.7, 0.8, 0.9, to about 1 cm. In some embodiments, the protrusion on the extension has a width of about 0.5 cm. In some embodiments the protrusion has a width of about 0.2, 0.3, 0.4, 0.5, 0.6, 0.7, 0.8, 0.9 to about 1 cm. In some embodiment the width of the protrusion is the same as the width of the extension as the protrusion. In some embodiment the width of the protrusion on the outer ring is the same as the width of the protrusion of the extension. In some embodiments, the diameter of the depression is about 0.2, 0.3, 0.4, 0.5, 0.6, 0.7, 0.8, 0.9, 1.2, 1.4, 1.6, 1.8, 2.2, 2.4, 2.5, 2.6, 2.8, to about 3 cm. In some embodiments, the center groove has a diameter corresponding to the diameter of the holding surface to receive the holding surface when the spinner is attached to the base.

In some embodiments, a kit for an attachable handheld fidget spinner, comprises an attachable handheld fidget spinner comprising a wing body having a cavity; and a core disposed inside the cavity, the core comprising a cylindrical disc, the cylindrical disc comprising a holding surface disposed at the center and an outer ring surrounded the holding surface; and a base comprising an extension such that the extension is removably attached to the core. In some embodiments, the outer ring comprises protrusion disposed evenly around an inner perimeter of the outer ring. In some embodiments, the outer ring comprises protrusion having a tapered edge configured to lock with the extension. In some embodiments, the extension comprises second protrusion disposed outwardly configured to lock with the outer ring. In some embodiments, the outer ring comprises protrusion having a tapered edge and the extension comprises second protrusion disposed outwardly such that the second protrusion is configured to hook onto the tapered edge and removably attach the attachable handheld fidget spinner to the base. In some embodiments, the extension surrounds a perimeter of the holding surface. In some embodiments, the wing body is configured to spin on the base.

In some embodiments, a kit for an attachable handheld fidget spinner, comprising a wing portion comprising a cavity and a blade, the blade having a proximal end near the cavity and a distal end away from the cavity, the blade having an increasing depth and an increasing width from the proximal end toward the distal end; a core disposed inside the cavity, the core comprising a cylindrical disc, the cylindrical disc comprising a holding surface disposed at the center of the cylindrical disc; an outer ring surrounded the holding surface; and a core groove in between the holding surface and the outer ring, the outer ring comprising protrusions facing the core groove, the protrusions configured to removably attach to an object; and a base comprising an extension, the extension having protrusions such that the protrusion of the extension is removably attached to the protrusion of the outer ring.

Figure 10:
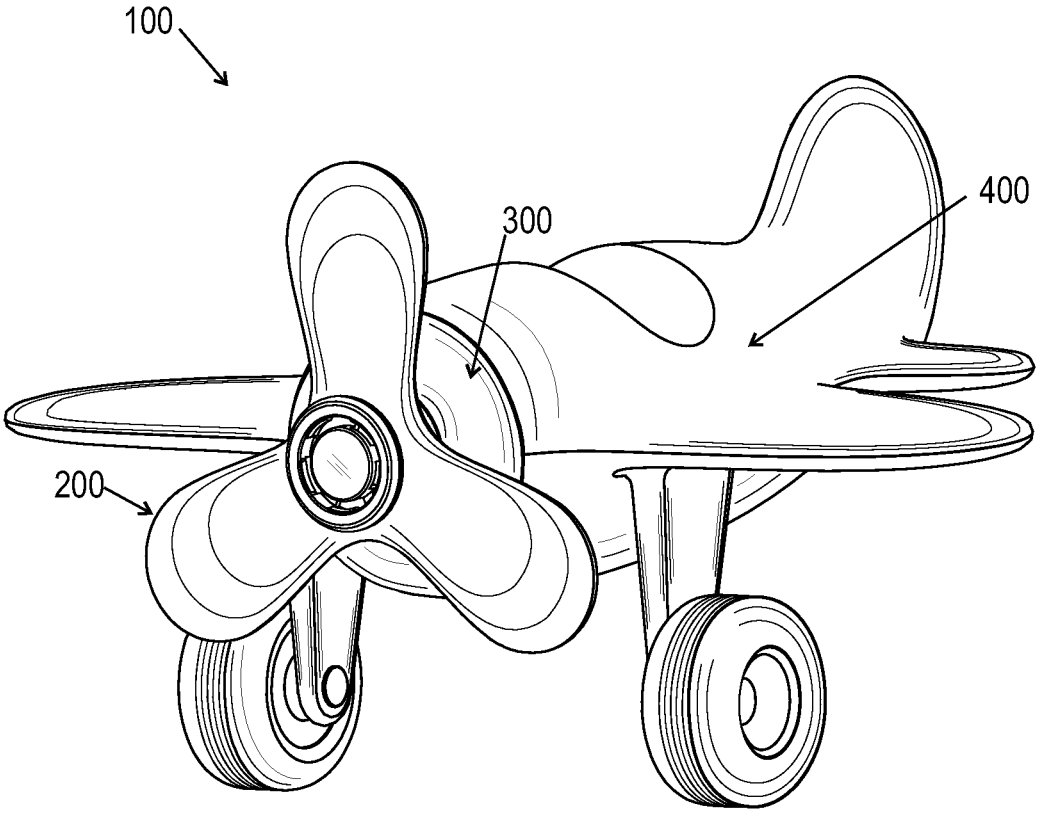
FIG. 10 is a perspective view of one embodiment of a kit including attachable handheld fidget spinner and a base on an airplane model.

In some embodiments, the base is a part of the object that the spinner attaches to. In some embodiments, the base can be formed as a part of another object, for example an airplane in toy model size as shown in FIG. 10. The attachable handheld fidget spinner is attached to the base on the airplane model thus presenting a completed airplane model with rotating blades in the front 400. In some embodiments, the base is part of a helicopter, motorcycle, windmill, and other toy or model products.

Method of Using the Attachable Handheld Fidget Spinner Kit

In some embodiments, the attachable handheld fidget spinner kit comprises, consists essentially of, or consists of an attachable handheld fidget spinner and a base. In some embodiments, a method of using an attachable handheld fidget spinner or an attachable handheld fidget spinner kit comprises, consists essentially of, or consists of the following features is provided. In some embodiments, the spinner comprises an outer ring enclosing a ring of groove, which encloses a circular holding surface. The base comprises a depression in the middle and an extension extending out perpendicularly from the bottom of the depression. In some embodiment the extension comprises a plurality of extensions forming a ring shape separating the depression into an inner circular groove, or a center groove, inside the ring and an outer groove having a doughnut shape. In some embodiments, a user aligns the holing surface of the spinner with the inner groove of the base, and then the user pushes the holding surface into the center groove. In one embodiment, the user aligns the outer ring of the spinner with the outer groove of the base, and then pushes the outer ring into the outer groove. These features allow the user to align the spinner and the base in any orientation as there is no specific key-hole structure that requires a user to orient the spinner or the base in certain arrangement. The user only needs to place the spinner in the middle of the base. The spinner does not need an additional component to attach to the base.

In some embodiments, the outer ring of the spinner comprises a boss or a protrusion. The depth of the protrusion extends inwardly toward the holding surface. The tip of the extension of the base also comprises a boss or a protrusion. The depth protrusion extends outwardly toward the outer groove of the base. The protrusion of the spinner and the protrusion both form a hook shape corresponding to engage each other such that once engaged, the spinner and the base are secured to each other. In some embodiments, the length of the protrusion of the spinner extends along the outer ring. In some embodiments, there are five protrusions. In some embodiments, there are one, two, three, four five, six, seven, eight, nice, ten, eleven, twelve, thirteen, fourteen, fifteen, sixteen, seventeen, eighteen, nineteen, or twenty protrusions. In some embodiments, the extension comprises a length extending vertically and perpendicularly from the bottom of the depression of the base. The extension comprises a width transverse to the length. The extension also comprises a depth across the diameter of the depression or the dimeter of the base. In some embodiments, the base has various shapes including circle, semi-circle oval, doughnut, rectangle, square, pentagon, hexagon, octagon, and/or a combination there of.

In some embodiments, a method of using a an attachable handheld fidget spinner comprising providing an attachable handheld fidget spinner comprising a wing body having a cavity; and a core disposed inside the cavity, the core comprising a cylindrical disc, the cylindrical disc comprising a holding surface disposed at the center and an outer ring surrounded the holding surface; providing a base comprising an extension such that the extension is removably connected to the holding surface; aligning the holding surface and the extension; and pushing the holding surface into the base such that the attachable handheld fidget spinner is removably attached to the base. In some embodiments, the outer ring comprises protrusions and the extension comprises second protrusions such that when the holding surface is pushed into the base, the protrusion and the second protrusion engage and lock onto each other. In some embodiments, the protrusion and the second protrusion lock on multiple points.

The length of the protrusion of the base extends along the width of the extension. In some embodiments, base comprises five protrusions. In some embodiments, there are one, two, three, four five, six, seven, eight, nice, ten, eleven, twelve, thirteen, fourteen, fifteen, sixteen, seventeen, eighteen, nineteen, or twenty protrusions. In some embodiments, the number of the protrusions on the spinner and the number of the protrusions on the base are not the same. In some embodiments, the number of the protrusions on the spinner and the number of the protrusions on the base are the same. The number and the position of the protrusion affect the stability of the spinner. To sufficient secure the spinner and the base and maintain the stability during the spinning cycles, the protrusions of the spinner and the protrusions of the base are evenly distributed and the engagement of protrusions are also evenly distributed. Overly engagement on one side or one direction will cause imbalance and very short spin cycle. In some embodiments, the spinning cycle last from at least about 60, 65, 70, 75, 80, 95, 90, 95, 100, 105, 110, 115, 120, 125, 130, 135, 140, 145, 150, 155, 160, 165,170, 175, to about 180 seconds with an initial speed of at least about 4, 5, 6, 7, 8, 9, to about 10 cycles per second. In some embodiments, the spinning cycle last at least from about 120 seconds to about 180 seconds with an initial speed of at least about 6 cycles per second. In a comparison study, the prior spinners last only approximately 15 seconds with an initial speed of at least about 6 cycles per second. In some scenarios, the prior spinners last only as short as 13 seconds.

Method of Making the Attachable Handheld Fidget Spinner Kit

In some embodiments, a method of making an attachable handheld fidget spinner or an attachable handheld fidget spinner kit comprises, consists essentially of, or consists of the following features is provided. In some embodiments, the method includes providing a wing body having a cavity, providing a core comprising a first portion and a second portion, the first portion having an axel ring and the second portion having an axel ring, placing the first portion into the cavity, placing the second portion into the cavity such that the axel ring of the first portion mates with the axel ring of the second portion and locks the core inside the cavity.

In some embodiments, the core further comprises a stability ring. The method comprises placing the stability ring through the axel ring and dispose adjacent to the inner ring of the first portion. In some embodiments, the core further comprises a second stability ring. The method comprises placing the second stability through the axel ring and adjacent to the inner ring of the second portion. In some embodiments, the method comprises placing the spinner in to the base to make the attachable handheld fidget spinner kit.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. An attachable handheld fidget spinner comprising a wing portion comprising a cavity and a blade, the blade having a proximal end near the cavity and a distal end away from the cavity, the blade having an increasing depth and an increasing width from the proximal end toward the distal end; and a core disposed inside the cavity, the core comprising a cylindrical disc, the cylindrical disc comprising a holding surface disposed at the center of the cylindrical disc; an outer ring surrounding the holding surface; and a core groove in between the holding surface and the outer ring, the outer ring comprising protrusions facing the core groove, the protrusions configured to removably attach to an object.

2. The attachable handheld fidget spinner in claim 1, wherein the object is a base having an extension configured to engage the cylindrical disc via the core groove.

3. The attachable handheld fidget spinner in claim 1, wherein the cylindrical disc further comprises a bridge connecting the holding surface to the outer ring.

4. The attachable handheld fidget spinner in claim 3, wherein the protrusion is disposed on an inner perimeter of the outer ring.

5. The attachable handheld fidget spinner in claim 1, wherein the protrusion comprises a body having a length extending around an inner diameter of the outer ring.

6. The attachable handheld fidget spinner in claim 1, wherein the core further comprises a second cylindrical disc having a second holding surface and a second outer ring having protrusions configured to removably attach to the object.

7. The attachable handheld fidget spinner in claim 1, wherein the core further comprises a first ring and a second ring disposed between the cylindrical disc and a second cylindrical disc, the first ring and the second ring configured to contact an inner groove of the wing body.

8. The attachable handheld fidget spinner in claim 1, wherein the cylindrical disc has an axel ring and the core further comprises a second cylindrical disc having a second axel ring.

9. The attachable handheld fidget spinner in claim 1, wherein the cylindrical disc further comprises a groove disposed between the holding surface and the outer ring configured to receive an object.

10. The attachable handheld fidget spinner in claim 1, wherein the second cylindrical disc comprises an axel ring having teeth surrounded the axel ring.

11. A kit for an attachable handheld fidget spinner, comprising a wing portion comprising a cavity and a blade, the blade having a proximal end near the cavity and a distal end away from the cavity, the blade having an increasing depth and an increasing width from the proximal end toward the distal end;

a core disposed inside the cavity, the core comprising a cylindrical disc, the cylindrical disc comprising a holding surface disposed at the center of the cylindrical disc; an outer ring surrounded the holding surface; and a core groove in between the holding surface and the outer ring, the outer ring comprising protrusions facing the core groove, the protrusions configured to removably attach to an object; and a base comprising an extension, the extension having protrusions such that the protrusions of the extension are removably attached to the protrusions of the outer ring.

12. The kit in claim 11, wherein the outer ring comprises protrusion disposed evenly around an inner perimeter of the outer ring.

13. The kit in claim 11, wherein the outer ring comprises protrusion having a tapered edge configured to lock with the extension.

14. The kit in claim 11, wherein the extension comprises second protrusion disposed outwardly configured to lock with the outer ring.

15. The kit in claim 11, wherein the protrusions of the outer ring having a tapered edge and the protrusion of the extension disposed outwardly such that the second protrusion is configured to hook onto the tapered edge and removably attach the attachable handheld fidget spinner to the base.

16. The kit in claim 11, wherein the extension surrounds a perimeter of the holding surface.

17. The kit in claim 11, wherein the wing body is configured to spin on the base.

18. A method of using an attachable handheld fidget spinner comprising providing an attachable handheld fidget spinner comprising a wing portion having a cavity; and a core disposed inside the cavity, the core comprising a cylindrical disc, the cylindrical disc comprising a holding surface disposed at the center and an outer ring surrounding the holding surface;

providing a base comprising an extension such that the extension is removably connected to the core;

aligning the holding surface and the extension; and pushing the holding surface into the base such that the attachable handheld fidget spinner is removably attached to the base, wherein the outer ring comprises protrusions and the extension comprises second protrusions such that when the holding surface is pushed into the base, the protrusion and the second protrusion engage and lock onto each other.

19. The method in claim 18, wherein the protrusion and the second protrusion lock on multiple points.

* * * * *